US005694970A

United States Patent [19]

Staranchuk

[11] Patent Number: 5,694,970

[45] Date of Patent: Dec. 9, 1997

[54] SAFETY VALVE FOR WATER SUPPLY SYSTEM

[76] Inventor: George P. Staranchuk, 2212 Harvey St., Regina, Saskatchewan, Canada, S4N 2N1

[21] Appl. No.: 764,440

[22] Filed: Dec. 12, 1996

[51] Int. Cl.[6] ..... F16K 31/02; F16K 35/02; H01H 35/00

[52] U.S. Cl. ..... 137/312; 122/504; 122/507; 200/61.04; 200/61.05; 251/113; 251/116; 251/129.17; 361/178

[58] Field of Search ..... 122/504, 504.2, 122/507; 137/312; 251/95, 111, 113, 129.15, 129.17; 200/61.04, 61.05, 182, 190; 307/118; 351/118; 361/178

[56] References Cited

U.S. PATENT DOCUMENTS

| | | | |
|---|---|---|---|
| 3,473,553 | 10/1969 | Collins | 137/312 |
| 3,770,002 | 11/1973 | Brown | 137/312 |
| 3,920,031 | 11/1975 | Maxfield | 137/312 |
| 4,252,088 | 2/1981 | Frisby | 137/460 |
| 4,324,268 | 4/1982 | Jacobson | 137/312 |
| 4,805,662 | 2/1989 | Moody | 137/312 |
| 4,869,461 | 9/1989 | Perry et al. | 251/129.15 |
| 4,890,635 | 1/1990 | Gray, Jr. | 137/75 |
| 4,944,253 | 7/1990 | Bellofatto | 137/312 |
| 5,029,605 | 7/1991 | Dowling et al. | 137/312 |
| 5,240,022 | 8/1993 | Franklin | 137/312 |
| 5,402,815 | 4/1995 | Hoch, Jr. | 137/312 |
| 5,501,425 | 3/1996 | Reinicke et al. | 251/129.15 |

FOREIGN PATENT DOCUMENTS

| | | | |
|---|---|---|---|
| 2814368 | 10/1978 | Germany | 251/129.15 |
| 2276656 | 10/1994 | United Kingdom | 251/129.15 |

*Primary Examiner*—George L. Walton

[57] ABSTRACT

A safety control valve for a domestic water supply system is described. It includes a valve body having a flow passage therethrough comprising a pair of laterally spaced vertical flow channels and a top flow cavity connecting these vertical flow channels. The top ends of the spaced flow channels open into a flat bottom face of the top flow cavity, which flat face forms a valve seat. A closure flap is mounted in the top cavity and is spring biased downwardly against the flat bottom face to close the valve. A central cylindrical cavity extends vertically between the bottom of the top flow cavity and the bottom of the valve body with a thin elastic diaphragm closing the top end of the cylindrical cavity. A solenoid is mounted on the bottom of the valve body concentric with the central cylindrical cavity. An actuating pin is mounted within the cylindrical cavity and solenoid, this actuating pin being spring biased upwardly such that when the solenoid is not activated the pin moves upwardly extending the diaphragm and pushing the closure flap upwardly to open the valve and when the solenoid is activated the pin is pulled downwardly thereby allowing the closure flap to move downwardly and close the valve. Connector means are provided for connecting the vertical flow channels to a water pipe and locking means are provided for locking the actuating pin in closed position. Finally, there is included a probe means for detecting a water leak and thereby activating the solenoid.

2 Claims, 3 Drawing Sheets

SAFETY VALVE FOR WATER SUPPLY SYSTEM

BACKGROUND OF THE INVENTION

This invention relates to a safety valve for turning off the water in a water supply system, when a leak has been detected.

It can be a very serious problem when a leak develops in a water supply system, such as a home owner's hot water heater. After returning from a vacation or other extended trip, it is not uncommon to find a basement flooded because of a leak which developed in the hot water heater. This can result in extensive and very costly property damage for the home owner.

Various systems have been proposed in the past to prevent damage from such leaks. One such system is described in Frisby, U.S. Pat. No. 4,252,088 issued Feb. 24, 1981. That system uses an arrangement of flappers in the inlet and outlet lines to a domestic hot water heater with a permanent magnet affixed to the bottom portion of each of the flappers. These are used in combination with magnetically operated switches which are in turn connected to a circuit with a relay for controlling a solenoid valve for cutting off or preventing entry of water from a source into an inlet pipe.

Another leakage protection device is described in Moody U.S. Pat. No. 4,805,662 issued Feb. 21, 1989. That system uses a ground fault interruptor circuit for detecting a leak and being adapted to close a solenoid valve thereby terminating the supply of water to the hot water heater when a leakage is detected.

The main problem with prior leakage control systems is that they have been unduly complicated and expensive. This has discouraged their use by home owners.

It is the object of the present invention to provide a very simple and inexpensive safety control valve for a water supply system having the additional advantage that it cannot accidentally be turned back on.

SUMMARY OF THE INVENTION

The present invention in its broadest aspect relates to a safety control valve for a water supply system. It includes a valve body having a flow passage therethrough comprising a pair of laterally spaced vertical flow channels and a top flow cavity connecting these vertical flow channels. The top ends of the spaced flow channels open into a flat bottom face of the top flow cavity, which flat face forms a valve seat. A closure flap is mounted in the top cavity and is spring biased downwardly against the flat bottom face to close the valve. A central cylindrical cavity extends vertically between the bottom of the top flow cavity and the bottom of the valve body with a thin elastic diaphragm closing the top end of the cylindrical cavity. A solenoid is mounted on the bottom of the valve body concentric with the central cylindrical cavity. An actuating pin is mounted within the cylindrical cavity and solenoid, this actuating pin being spring biased upwardly such that when the solenoid is not activated the pin moves upwardly extending the diaphragm and pushing the closure flap upwardly to open the valve and when the solenoid is activated the pin is pulled downwardly thereby allowing the closure flap to move downwardly and close the valve. Connector means are provided for connecting the vertical flow channels to a water pipe and locking means are provided for locking the actuating pin in closed position. Finally, there is included a probe means for detecting a water leak and thereby activating the solenoid.

The locking means is preferably in the form of a horizontally slidable pin spring biased against the actuating pin and being adapted to enter a recess in the side of the actuating pin when the actuating pin moves down to the closed position. The locking pin preferably includes a manual release so that the valve cannot accidentally open while a leak is still being detected.

BRIEF DESCRIPTION OF THE DRAWINGS

In the accompanying drawings which form part of the instant specification and are to be read in conjunction therewith and in which like numbers refer to like parts throughout the general views.

DESCRIPTION OF THE PREFERRED EMBODIMENT

Figure 1:
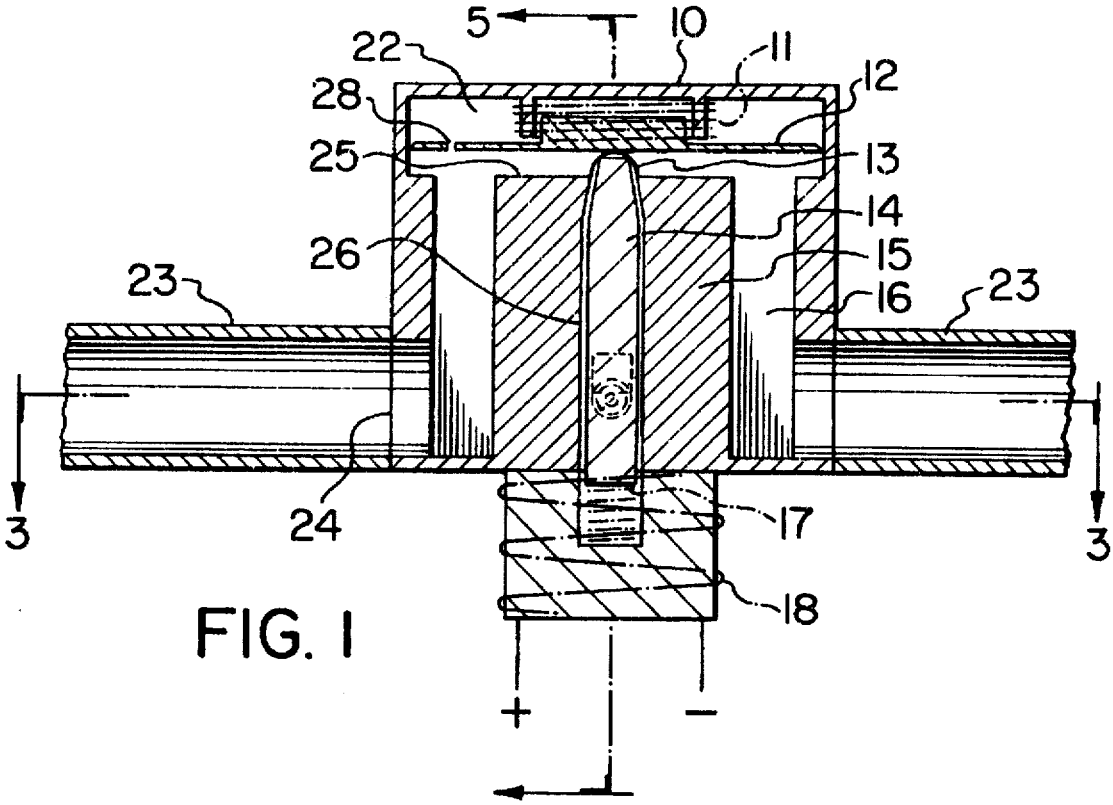
FIG. 1 is an elevation view in section of a valve according to the invention in the open position.
Figure 3:
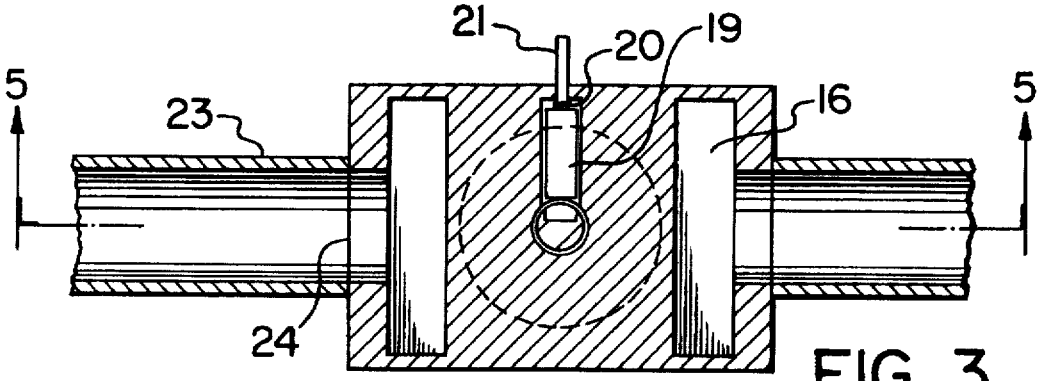
FIG. 3 is a sectional view along line 3—3 of FIG. 1.
Figure 5:
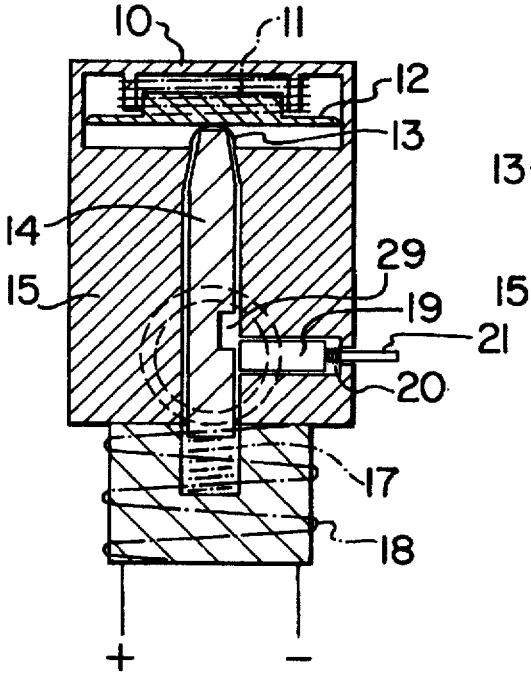
FIG. 5 is a sectional view along line 5—5 of FIG. 3.

Referring now to FIGS. 1, 3 and 5 of the drawings, there is shown a typical valve according to the present invention in the normal open operating position. It includes a main valve body 10 having a flow path therethrough comprising a pair of laterally spaced vertical flow channels 16 and a top flow cavity 22 connecting the channels 16. The top ends of the flow channels 16 open into a flat bottom face 25 of the top flow cavity 22, this flat face 25 forming a valve seat.

A closure flap 12 is mounted in the top cavity 22 and is spring biased downwardly against the flat bottom face 25 by means of spring 11.

Figure 2:
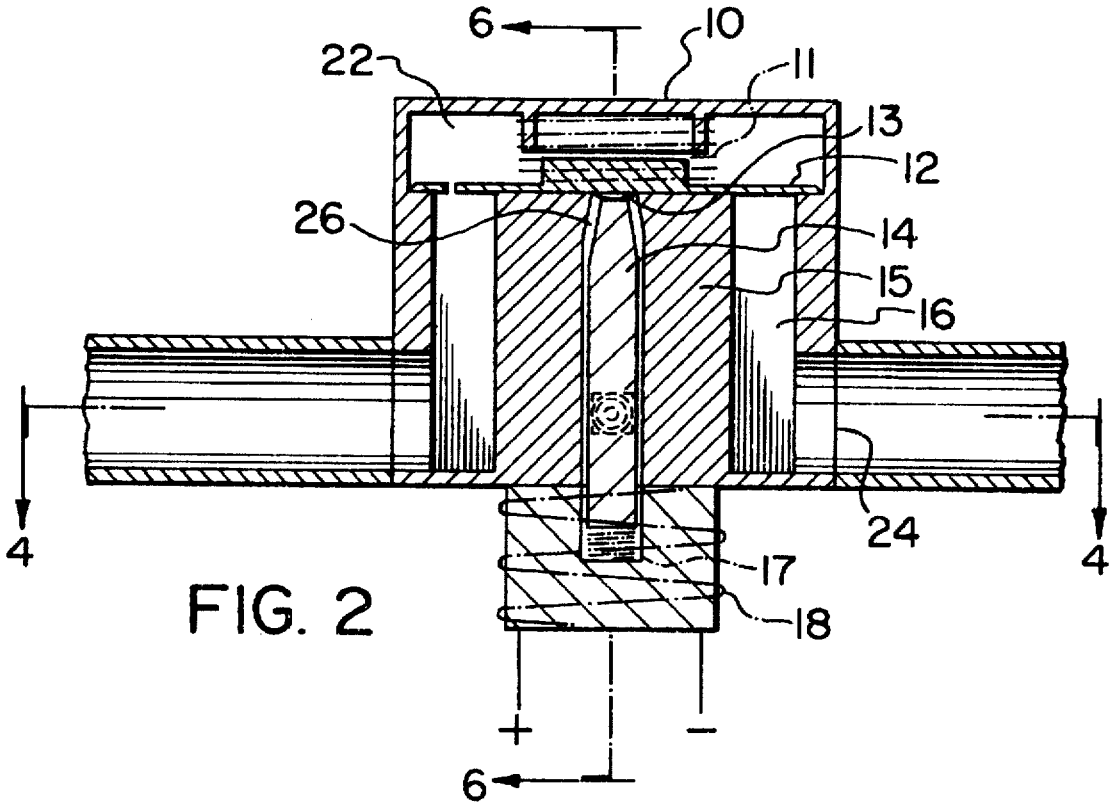
FIG. 2 is an elevational view in section showing the valve in closed position.
Figure 4:
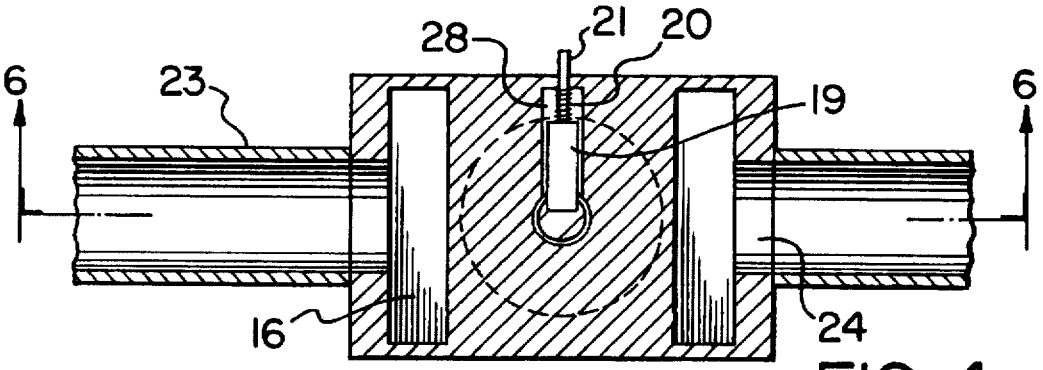
FIG. 4 is a sectional view along line 4—4 of FIG. 2.
Figure 6:
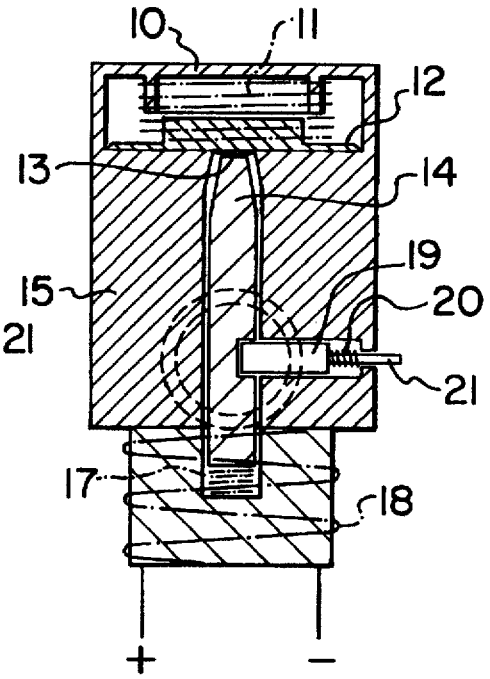
FIG. 6 is a sectional view along line 6—6 of FIG. 4.

A central cylindrical cavity 26 extends vertically between the top flow cavity 22 and the bottom of the valve body. The opening of the cavity 26 into top flow cavity 22 is closed by means of a thin elastic diaphragm 13 which serves as a water seal. Mounted on the bottom of the valve body 10 is a solenoid 18 with a central opening concentric with the cavity 26. An actuating pin 14 is mounted within the cavity 26 and solenoid 18 and this pin 14 is spring biased upwardly by means of spring 17 such that when the solenoid 18 is not activated, the pin 14 moves upwardly extending the diaphragm 13 and pushing the closure flap 12 upwardly to open the valve. When the solenoid 18 is activated, the pin 14 is pulled downwardly (as shownin FIGS. 2, 4 and 6) thereby allowing the closure flap 12 to move downwardly and close the valve.

The safety control valve also preferably includes a safety locking mechanism for locking the valve in the closed position thereby preventing any accidental re-opening of the valve after a leak has been detected. This locking mechanism is conveniently in the form of a horizontally slidable pin 19 mounted in a cavity 28 within the valve body 10. This locking pin 19 is spring biased inwardly by means of spring 20 and also includes an outwardly extending manual reset pin 21.

The actuating pin 14 includes a recess 29 in a side face thereof and it is adapted to align with locking pin 19 when actuating pin 14 is in the downward closed position. As can be seen from FIGS. 4 and 6, in the closed position, the locking pin 19 enters the recess 29 thereby preventing the reopening of the valve until locking pin 19 is manually released by means of the manual reset pin 21.

The valve body 10 also includes flow openings 24 in the side walls connecting to the flow channels 16. Connected to these openings 24 are nipples 23 adapted to be connected into a cold water supply line (not shown).

It is advantageous to include a small hole or holes 28 in the closure flap 12. This equalizes pressure on the faces of the flap after it has been either closed or opened. As a result, the flap is more responsive and the differentials of spring pressures are less critical.

Figure 7:
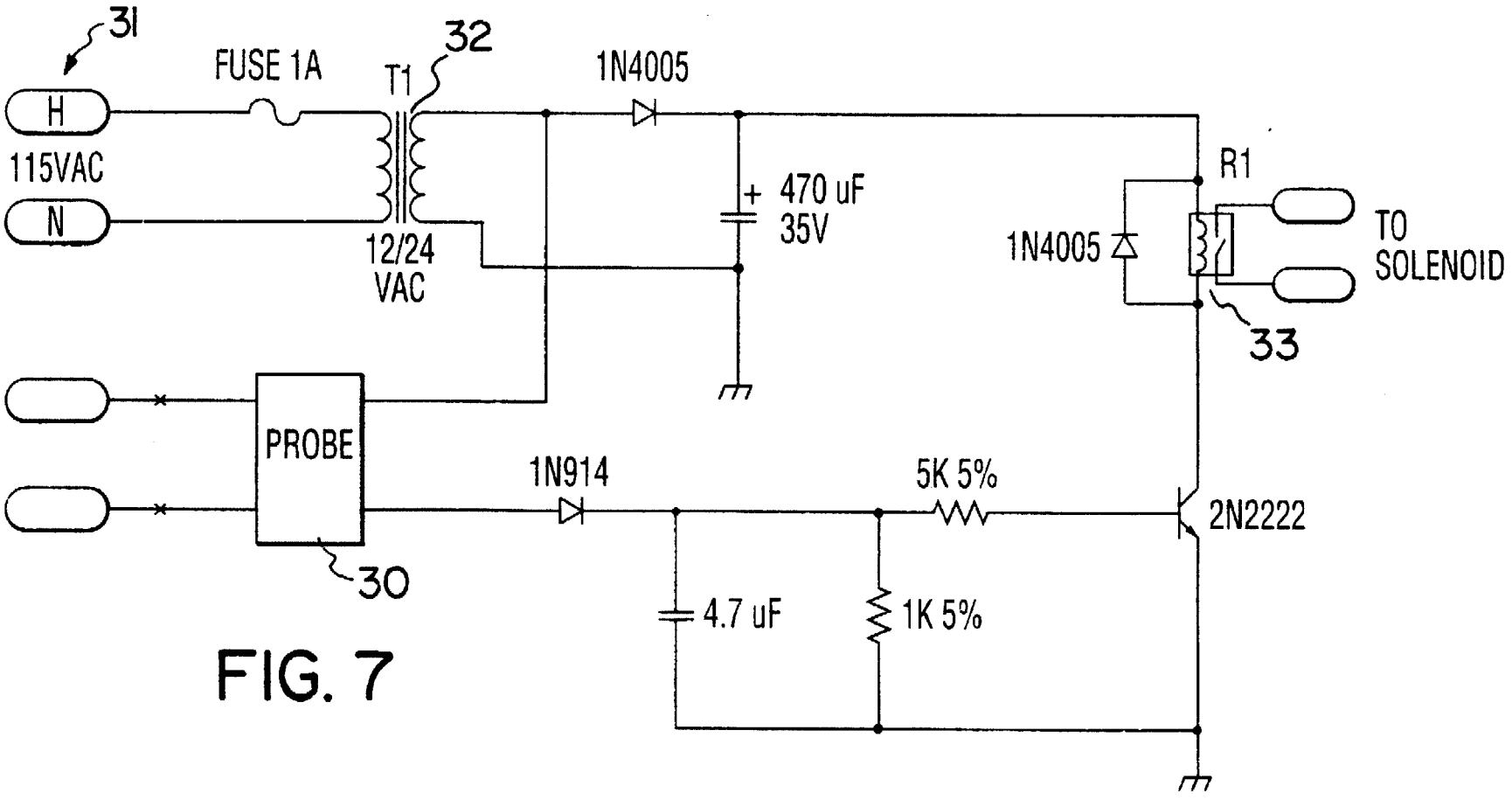
FIG. 7 is a schematic wiring diagram of the present invention.

When a leak is detected, the valve of the invention is closed by means of a circuit as shown in FIG. 7. This includes a typical moisture detecting probe 30 connected to a circuit powered by a standard 115 volt AC circuit 31 with a transformer 32. This transformer 32 may have a 12 or 24 volt AC secondary. This circuitry is conveniently in a small case plugged into a wall socket, with external connectors for the probe and the solenoid.

The solenoid is powered by a 115 volt AC circuit and is actuated by means of a normally open relay switch 33. When probe 30 detects a leakage, this causes the relay switch 33 to close thereby activating the solenoid and closing valve 10.

While a specific embodiment of the invention has been described as applied to domestic hot water heaters, it should be realized that the principles disclosed herein could be readily adapted to any type of piping system carrying a liquid.

I claim:

1. A safety control valve operably attached to a hot water heater comprising:

a valve body having a flow passage therethrough comprising a pair of laterally spaced vertical flow channels and a top flow cavity connecting said vertical flow channels with top ends of said flow channels opening into a flat bottom face of said top flow cavity forming a valve seat, a closure flap mounted in said top cavity and spring biased downward against said flat bottom face to close the valve, a central cylindrical cavity extending vertically between said top flow cavity and the bottom of the valve body with a thin elastic diaphragm attached to a portion of the valve body and extending therefrom across and closing the top end of the cylindrical cavity and a solenoid mounted on the bottom of the valve body concentric with said central cylindrical cavity, an actuating pin mounted within said cylindrical cavity and solenoid, said actuating pin being spring biased upwardly such that when the solenoid is not activated the pin moves upwardly extending the diaphragm and pushing the closure flap upwardly to open the valve and when the solenoid is activated the pin is pulled downwardly relaxing the diaphragm and thereby allowing the closure flap to move downwardly and close the valve, connector means for connecting said vertical flow channels to a water pipe, manual releasable locking means for locking said actuating pin in a closed position comprising a horizontally slidable pin spring biased against said actuating pin and being adapted to enter a recess in the side of said actuating pin when the actuating pin is moved downwardly to the closed position and being adapted to be released from the actuating pin to permit the actuating pin to be moved upwardly to an open position and means for detecting a water leak in the hot water heater and thereby activating the solenoid to move the actuating pin downwardly to permit the closure flap to be moved to the closed position.

2. A safety valve according to claim 1 wherein the top flow cavity is at least one of rectangular and square in cross-section.

* * * * *